US011148763B2

(12) United States Patent
Moltrup

(10) Patent No.: US 11,148,763 B2
(45) Date of Patent: Oct. 19, 2021

(54) FLOATABLE APPARATUS AND A COUPLING ASSEMBLY FOR A FLOATABLE APPARATUS

(71) Applicant: Neil Pryde Limited, Tuen Mun (HK)

(72) Inventor: Lars Moltrup, Pukalani, HI (US)

( * ) Notice: Subject to any disclaimer, the term of this patent is extended or adjusted under 35 U.S.C. 154(b) by 0 days.

(21) Appl. No.: 16/412,694

(22) Filed: May 15, 2019

(65) Prior Publication Data

US 2020/0361580 A1 Nov. 19, 2020

(51) Int. Cl.

| | |
|---|---|
| ***B63B 32/60*** | (2020.01) |
| ***B63B 32/20*** | (2020.01) |
| ***B63B 32/66*** | (2020.01) |

(52) U.S. Cl.

CPC ..... *B63B 32/60* (2020.02); *B63B 32/20* (2020.02); *B63B 32/66* (2020.02)

(58) Field of Classification Search

CPC ..... B63B 35/00; B63B 35/73; B63B 35/79; B63B 41/00; B63B 32/20; B63B 32/66; B63B 32/60; B63B 35/7923; B63B 35/7926

USPC ..... 441/79

See application file for complete search history.

(56) References Cited

U.S. PATENT DOCUMENTS

| | | | | |
|---|---|---|---|---|
| 4,398,485 | A * | 8/1983 | Diziere | B63B 32/66 441/79 |
| 5,215,488 | A * | 6/1993 | Bailey | B63B 32/66 441/79 |
| 7,244,157 | B2 * | 7/2007 | Simpson | B63B 32/60 441/79 |
| 9,908,596 | B2 * | 3/2018 | Watson | B63B 32/66 |
| 2008/0305698 | A1 * | 12/2008 | Rosiello | B63B 32/20 441/79 |

* cited by examiner

*Primary Examiner* — Lars A Olson

(74) *Attorney, Agent, or Firm* — Renner, Kenner, Bobak, Taylor & Weber

(57) ABSTRACT

A floatable apparatus includes a floatable body defining a longitudinal axis parallel with the length of the floatable body, a supporting member positioned under the floatable body for exerting a lifting force onto the floatable apparatus and a coupling assembly coupling the floatable body to the supporting member. The coupling assembly includes a base adapted to secure to the floatable body and a joint adapted to secure to the supporting member. The joint is detachably attached to the base and movable from a first position at which the joint is pivotable about and detachable from the base and a second position at which the joint abuts and is secured to the base. A coupling assembly for a floatable apparatus with a floatable body under which a supporting member is positioned for exerting a lifting force onto the floatable apparatus is also provided.

23 Claims, 8 Drawing Sheets

FLOATABLE APPARATUS AND A COUPLING ASSEMBLY FOR A FLOATABLE APPARATUS

FIELD OF THE INVENTION

The invention relates to a floatable apparatus and to a coupling assembly for a floatable apparatus. In particular, but not exclusively, the invention relates to a water sports board and to a coupling assembly for a water sports board, such as a surfboard.

BACKGROUND TO THE INVENTION

Floatable apparatus are becoming increasingly popular with more and more enthusiasts of water sports looking for additional elements or accessories to make their water sports experience or water sports apparatus more unique, faster, or more challenging. Increased interest in this area has led to the inclusion of mounting accessories to floatable bodies such as water sports boards, including fins, fin boxes, or hydrofoils. The mounting accessories or supporting members are often large and bulky structures which make them difficult to carry and so are most commonly secured to the water sports boards just before use. Coupling assemblies that secure the supporting members to the floatable apparatus must be strong and able to maintain the supporting member in position on the floatable body whilst enabling quick and easy user handling. Improved floatable apparatus and a coupling assembly for a floatable apparatus are desired.

SUMMARY OF THE INVENTION

An objective of the present invention is directed to providing a floatable apparatus and/or a coupling assembly for a floatable apparatus that is comfortable and easy to operate and allows for easy assembly and disassembly.

The above object is met by the combination of features of the main claim; the sub-claims disclose further advantageous embodiments of the invention. One skilled in the art will derive from the following description other objects of the invention. Therefore, the foregoing statements of object are not exhaustive and serve merely to illustrate some of the many objects of the present invention.

In accordance with an example embodiment of the first aspect of the present invention, there is provided a floatable apparatus, comprising:

- a floatable body defining a longitudinal axis parallel with the length of the floatable body,
- a supporting member positioned under the floatable body for exerting a lifting force onto the floatable apparatus,
- a coupling assembly coupling the floatable body to the supporting member, comprising:
  - a base adapted to secure to the floatable body, and
  - a joint adapted to secure to the supporting member and detachably attached to the base, and wherein the joint is movable between a first position at which the joint is pivotable about and detachable from the base and a second position at which the joint abuts and is secured to the base.

In an embodiment of the first aspect, the joint is parallel to the longitudinal axis at the second position.

In an embodiment of the first aspect, the joint is transverse to the longitudinal axis at the first position.

In an embodiment of the first aspect, the base is attached to the floatable body.

In an embodiment of the first aspect, the joint is secured to the base by a locking means.

In an embodiment of the first aspect, the locking means comprises a mounting member on one end and a tightening control member on the other end.

In an embodiment of the first aspect, the mounting member is mounted on the base and defines a mounting axis perpendicular to the longitudinal axis.

In an embodiment of the first aspect, the tightening control member is pivotable about a pivot axis perpendicular to the longitudinal axis.

In an embodiment of the first aspect, the locking means further comprises a blocking member that blocks the tightening control member pivoting about the pivot axis.

In an embodiment of the first aspect, the locking means comprises a tightening shaft including a screw portion on one end and a tightening control member on the other end.

In an embodiment of the first aspect, the tightening shaft is rotatable about the longitudinal axis.

In an embodiment of the first aspect, the tightening control member is pivotable about an axis perpendicular to the tightening shaft after rotation of the screw portion.

In an embodiment of the first aspect, the floatable body is a water sports board.

In an embodiment of the first aspect, the supporting member is a mast.

In an embodiment of the first aspect, the supporting member is a hydrofoil mast.

In accordance with an example embodiment of the second aspect of the present invention, there is provided a coupling assembly for a floatable apparatus with a floatable body under which a supporting member is positioned for exerting a lifting force onto the floatable apparatus, the coupling assembly comprising:

- a base adapted to secure to said floatable body; and
- a joint adapted to secure to said supporting member and detachably attached to the base, the joint being movable between a first position at which the joint is pivotable about and detachable from the base and a second position at which the joint abuts and is secured to the base.

In an embodiment of the second aspect, the joint is parallel to the longitudinal axis at the second position.

In an embodiment of the second aspect, the joint is transverse to the longitudinal axis at the first position.

In an embodiment of the second aspect, the joint is secured to the base by a locking means.

In an embodiment of the second aspect, the locking means comprises a mounting member on one end and a tightening control member on the other end.

In an embodiment of the second aspect, the mounting member is mounted on the base and defines a mounting axis perpendicular to the longitudinal axis.

In an embodiment of the second aspect, the tightening control member is pivotable about a pivot axis perpendicular to the longitudinal axis.

In an embodiment of the second aspect, the locking means further comprises a blocking member that blocks the tightening control member pivoting about the pivot axis.

In an embodiment of the second aspect, the locking means comprises a tightening shaft rotatable about the longitudinal axis, including a screw portion on one end and a tightening control member on the other end.

In an embodiment of the second aspect, the tightening control member is pivotable about an axis perpendicular to the tightening shaft after rotation of the screw portion.

In an embodiment of the second aspect, the floatable body is a water sports board.

In an embodiment of the second aspect, the supporting member is a mast.

In an embodiment of the second aspect, the supporting member is a hydrofoil mast.

Further aspects of the invention will become apparent from the following description which is given by way of example only.

BRIEF DESCRIPTION OF THE DRAWINGS

Embodiments of the present invention will now be described, by way of example, with reference to the accompanying drawings, in which.

DESCRIPTION OF PREFERRED EMBODIMENTS

Figure 1:
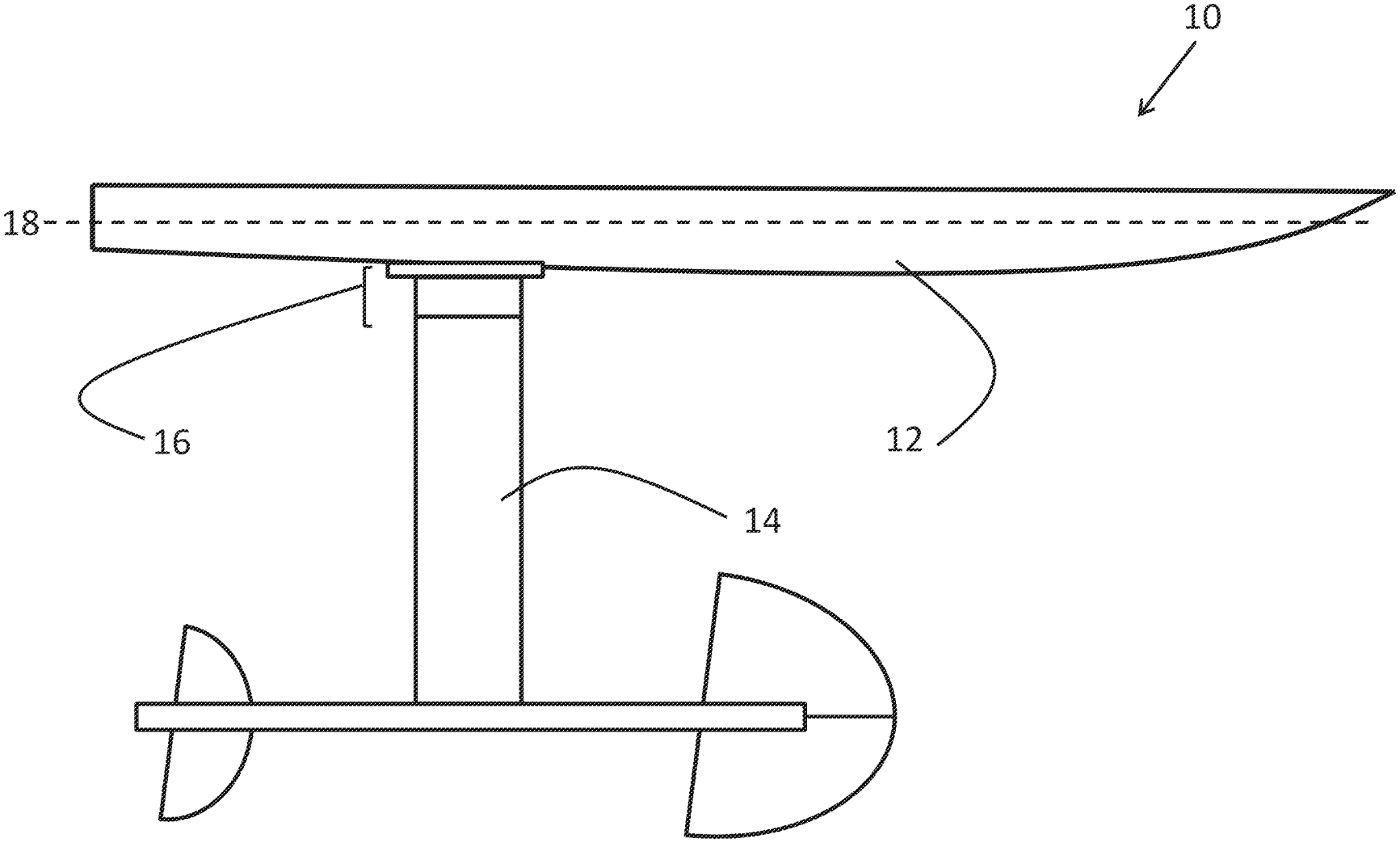
FIG. 1 illustrates the components of a floatable apparatus in accordance with an example embodiment.
Figure 2:
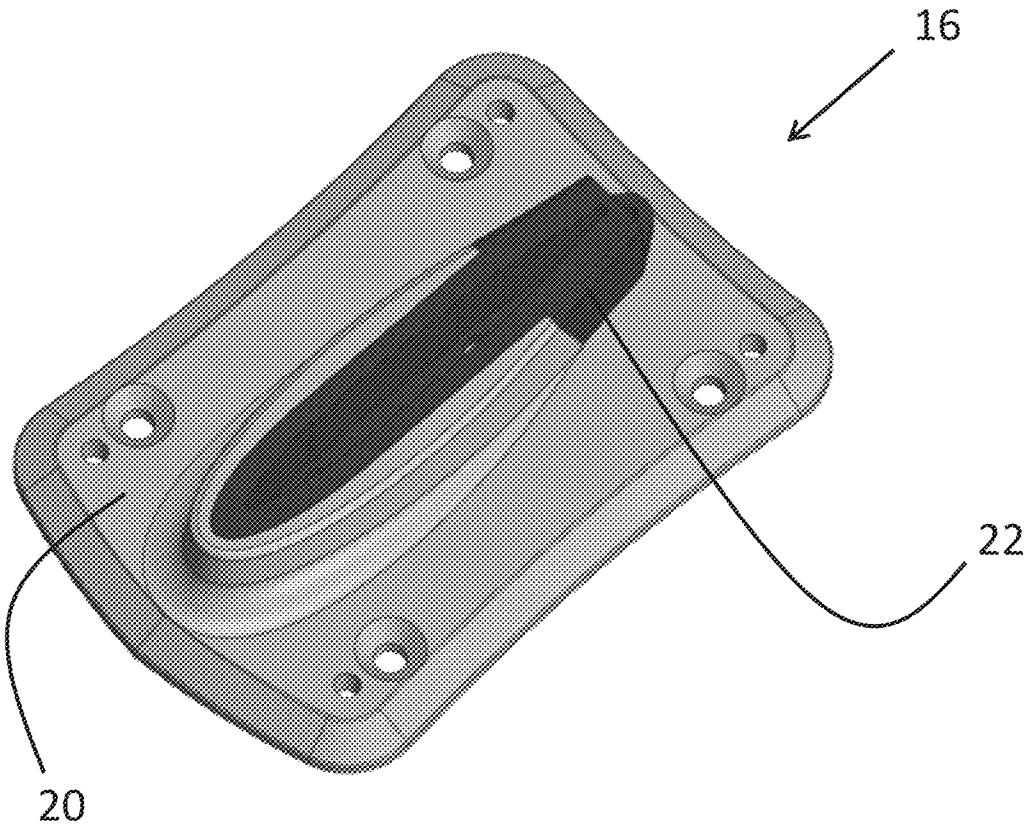
FIG. 2 illustrates a perspective view of a coupling assembly in accordance with an example embodiment.

In the following claims and description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The following description is given by way of example only to illustrate the invention. It is not intended to limit the scope of use or functionality of the invention. In particular, the invention is not limited in its application to the details of construction and the arrangements of components set forth in the following description or illustrated in the accompanying drawings. Moreover, it should be understood that any phraseology and terminology used is for the purpose of description and should not be regarded as limiting on the scope of the invention.

The rise in popularity of water sports worldwide has seen the evolution of floatable apparatus' to include additional mounting accessories that provide enthusiasts with increased speed, enjoyment, challenge, or a more unique experience. Mounting accessories include, for example, supporting members like hydrofoils, fins, fin boxes, electric propulsion systems and the like, that exert a lifting force onto the floatable apparatus. These supporting members are typically available as separate accessories that are mounted on a floatable body, usually the underside of the floatable body, before use. The supporting members, given their weight and size, can be cumbersome to handle and are commonly attached to the floatable body just before use of the supporting member at the desired destination.

Given their large and often bulky structure, the supporting members can be difficult to transport and handle, particularly during assembly and disassembly of the supporting member on the floatable body. The supporting members will also be required to withstand considerable force that will be exerted during use in difficult and unpredictable environments like the ocean. Attachment of the supporting member to the floatable body commonly requires time and effort by a user, particularly due to the need for, and reliance on, additional tools. The requirement for additional tools makes the coupling of the supporting member to the floatable body both tedious and inconvenient, disadvantaging the user by adding more time and additional elements/steps to the coupling process. Accordingly, a coupling device that couples the floatable body to the supporting member needs to be user-friendly, allowing for easy and efficient assembly before use and disassembly after use, as well as strong and secure to maintain the supporting member in position on the floatable body during use in the sea or ocean.

Figure 3:
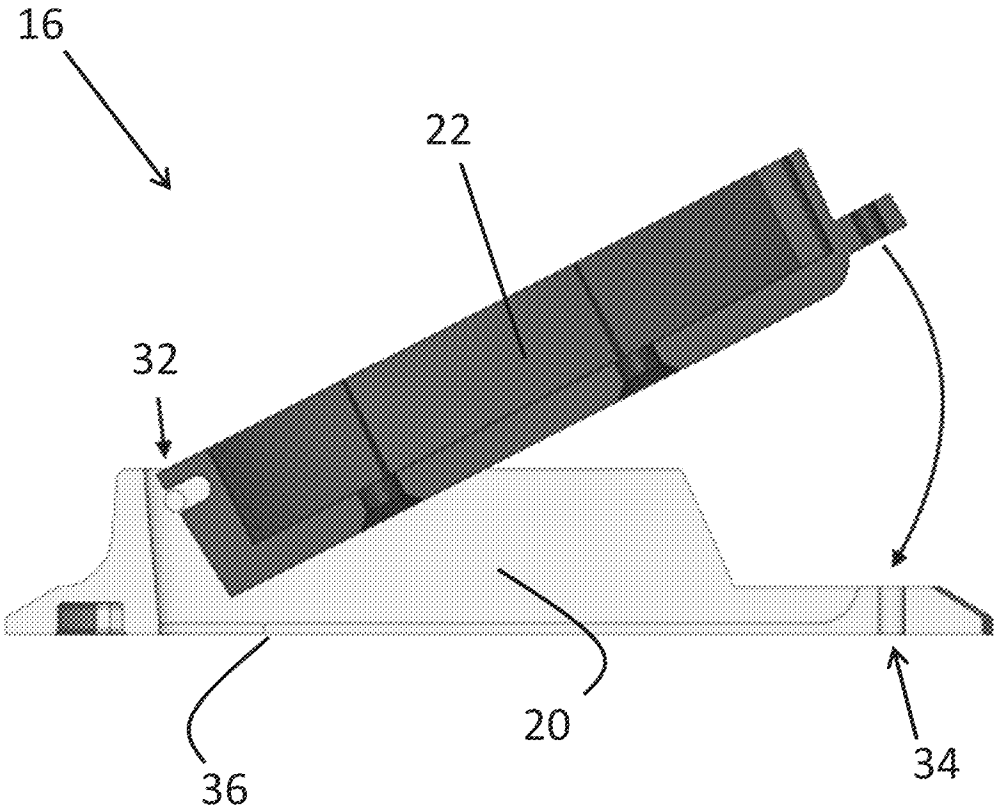
FIG. 3 is a cross-sectional side view illustration of the coupling assembly in a first position.
Figure 4A:
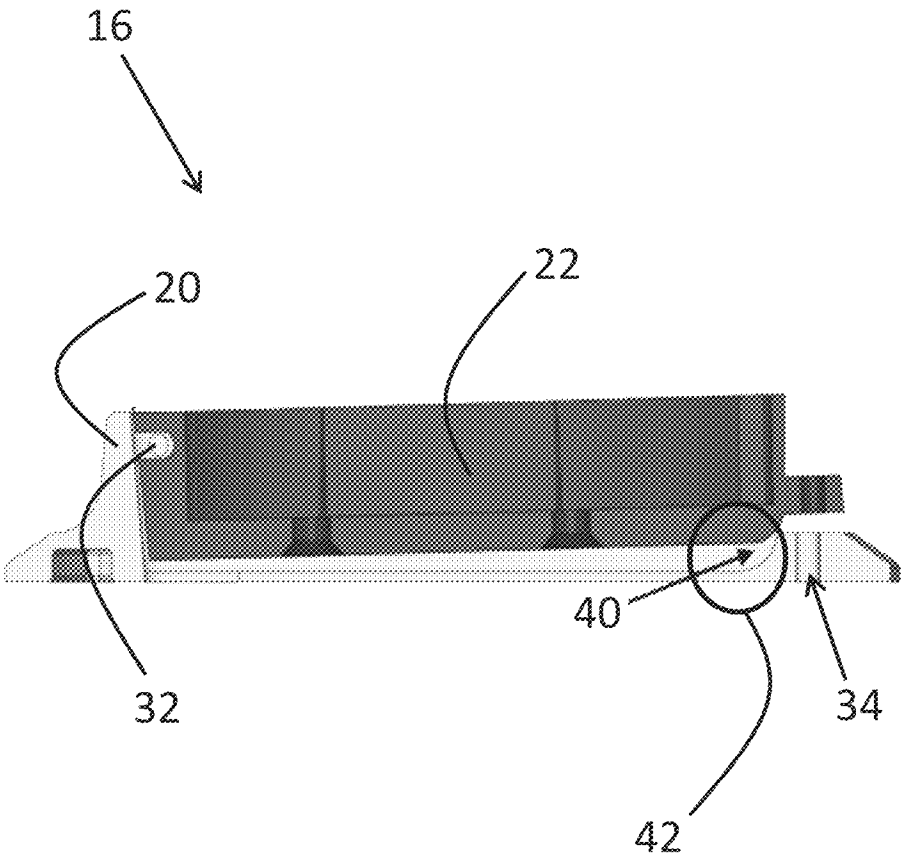
FIG. 4A is a cross-sectional side view illustration of the coupling assembly.
Figure 5B:
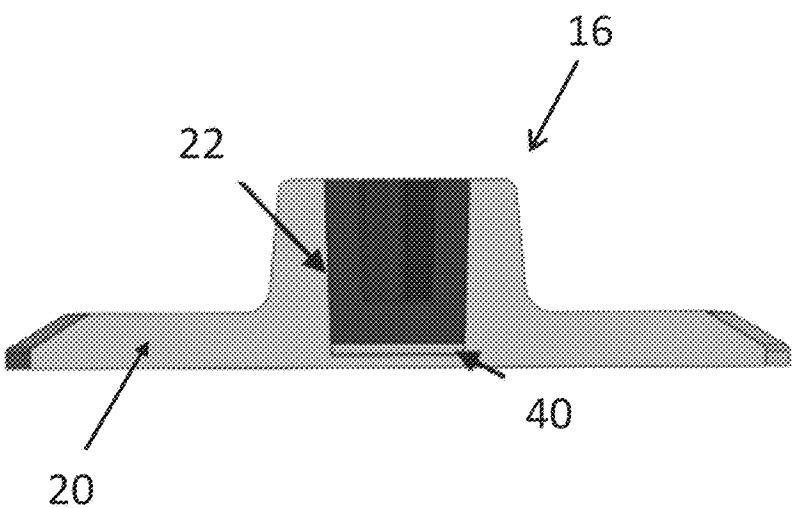
FIG. 5B is a cross-sectional front view illustration of the coupling assembly in the second position.
Figure 5A:
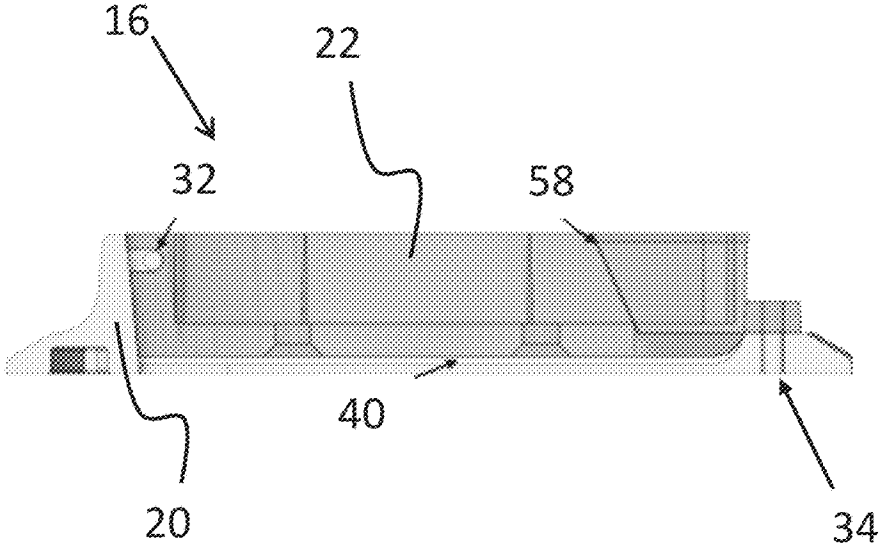
FIG. 5A is a cross-sectional side view illustration of the coupling assembly in a second position.

Referring firstly FIGS. 1-3 and 5A, the present invention provides a floatable apparatus 10 comprising a floatable body 12 defining a longitudinal axis 18 parallel with the length of the floatable body 12, a supporting member 14 positioned under the floatable body 12 for exerting a lifting force onto the floatable apparatus 10, and a coupling assembly 16 coupling the floatable body 12 to the supporting member 14. The coupling assembly 16 includes a base 20 adapted to secure to the floatable body 12, and a joint 22 adapted to secure to the supporting member 14 and detachably attached to the base 20; wherein the joint 22 is movable between a first position, an example of which is shown in FIGS. 3 and 4A, at which the joint 22 is pivotable about and detachable from the base 20, and a second position, an example of which is shown in FIG. 5A, at which the joint 22 abuts and is secured to the base 20.

With reference to FIG. 2-5A, in an example embodiment, the coupling assembly 16 provided comprises a base 20 and a joint 22. The base 20 of the coupling assembly 16 is adapted to be secured to the floatable body 12, preferably to the underside of the floatable body 12. In a further example embodiment, the base 20 includes a cavity adapted to receive the joint 22 during assembly of the floatable apparatus 10. The joint 22 may be attached to the base 20 by sliding the joint 22 into the cavity of the base 20 and rotating around the pivot 32 of the base 20.

During attachment of the joint 22 to the base 20, the joint 22 is movable from a first position (FIG. 3, FIG. 4A) where the joint is transverse to the longitudinal axis 18, to a second position (FIG. 5) where the joint 22 is parallel to the longitudinal axis 18 at which the joint 22 abuts and is secured to the base, for example, at an attachment point 34.

As illustrated in FIG. 3, for easy attachment, the joint 22 is preferably not fully engaged on the pivot 32, thereby allowing sufficient space for the joint 22 to rotate about the pivot 32 and onto the base 20. The shape of the rear of the base 20 and the joint 22 nearest the attachment point 34, i.e. opposite the pivot, facilitates easy assembly of the joint 22 and the base 20. In an example embodiment and with reference to FIGS. 6A and 6B, the rear of the base 20 and the joint 22 nearest the attachment point 34 is a straight surface that allows for easy assembly of the coupling assembly 16. Preferably, the straight surface is greater than 30 degrees. More preferably, the straight surface is 45 degrees.

In an alternative embodiment, the rear of the base 20 and the joint 22 nearest the attachment point 34 are curved to facilitate easy rotation of the joint 22 into the base 20. With reference to FIG. 4A, the curved shape 42 of the rear of the base 20 and the joint 22 nearest the attachment point also provides sufficient space for rotation of the joint 22 about the pivot 32 such that the front of the joint 22 does not make contact with the base 20 during assembly.

Figure 4B:
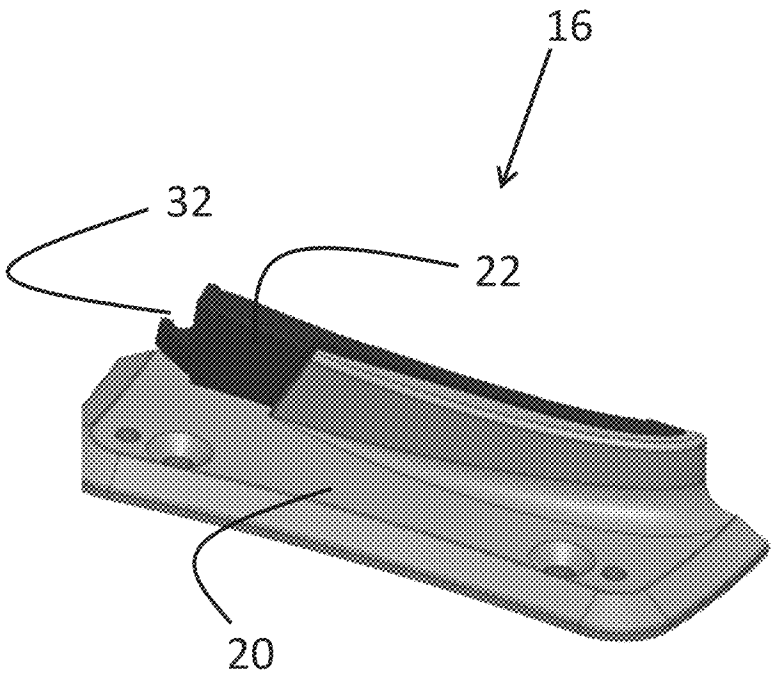
FIG. 4B is a perspective illustration of the side of the coupling assembly.

Turning to FIG. 4B, in order to maximise efficiency and facilitate assembly of the coupling assembly 16, the exterior of the joint 22 and the base 20 adapted to receive the joint 22 are cut with an angle of a few degrees in order to eliminate surface contact between the exterior of the joint 22 and the base 20 during assembly thereby allowing the joint 22 to slide into the base 20 easily and with minimal friction.

As illustrated in FIG. 5B, the base 20 and joint 22 are preferably tapered to allow for efficient and easy assembly and to minimise play or backlash. For example, when the joint 22 is attached to the base 20 and the coupling assembly 16 is engaged, there is play or backlash on the pivot 32 and the exterior 58 of the joint 22 (FIG. 5A) that advantageously allows for pressure to be absorbed by the tapered shape of the base 20 and joint 22. In a preferred embodiment, there is a gap 40 between the bottom of the joint 22 and the cavity of the base 20 when the joint 22 is in the second position, as illustrated in FIG. 5A, to ensure pressure is absorbed by the tapered shape and to ensure there is no horizontal contact between the joint 22 and the base 20. Advantageously, the tapered shape of the joint 22 and the base 20 allows the assembly of the base 20 and joint 22 without any play or backlash, regardless of defaults in machining or wear. Preferably, the coupling assembly 16 is also shaped so as to not impede the hydrodynamics of the floatable body 12.

In an example embodiment, the base 20 may be made of any suitable material that is preferably rigid, light-weight, waterproof, and provides sufficient strength for holding the components of the floatable apparatus 10, particularly when forces are applied to the floatable apparatus 10 during use. Further, the material the base 20 should preferably distribute load evenly. A preferred material for the base 20 is aluminium, preferably 6061 aluminium alloy. The base 20 may be produced by a fabrication process, that may, for example, include manufacturing steps such as forging, computer numerically controlled (CNC) machining and CNC extrusion.

In a further example embodiment, the joint 22 may be made of a suitable material that is durable, strong, waterproof and lightweight. Preferably, the joint 22 is made of aluminium alloy, most preferably 6061 aluminium alloy. In a further preferred embodiment, the joint 22 is made of plastic, preferably PA66 plastic. The joint 22 may be produced by a fabrication process that includes, for example, manufacturing steps such as forging, CNC machining, CNC extrusion, and injection (for plastic material).

With reference to FIG. 3, the bottom surface 36 of the base 20 is adapted to be attached to the floatable body 12, preferably the underside of the floatable body 12 by an attachment method that, preferably, does not puncture the outer shell of the floatable body 12 and potentially compromise the integrity of the floatable body 12. For example, methods of attachment may include adhering, bonding, bolting, screwing, strapping, melting, and/or combinations thereof. Similarly, the joint 22 is adapted to be secured to the supporting member 14 and methods of attachment may include adhering, bonding, bolting, screwing, strapping, melting, and/or combinations thereof. Typically, the base 20 is attached to the floatable body 12 such that the body 20 extends longitudinally along the longitudinal axis 18 of the floatable body 12.

It will be understood by those skilled in the art that other materials may be used for the base 20 and the joint 22, and other manufacturing/fabrication processes or steps may be used in the production of the base 20 and joint 22, and other methods of attachment of the base 20 to the floatable body 12 and/or the joint 22 to the supporting member 14 may be used without departing from the spirit of the present invention.

The floatable apparatus 10 of the present invention presents the distinct advantage of attachment and separation of the supporting member 14 to/from the floatable body 12 without the need for additional tools allowing for quick and hassle-free user handling. In another example embodiment, the joint 22 is secured to the base 20, preferably at an attachment point 34, by a locking means 50. In a preferred embodiment, the locking means 50 allows for the simple assembly and disassembly of the joint 22 to/from the base 20 and tightens, loosens, secures and releases the joint 22 to and from the base 20 without the need for additional tools. For example, when the joint 22 is being secured to the base 20, the joint 22 is detachably attached to the base 20 by rotation about the pivot 32 such that the joint 22 is movable between a first position (FIG. 3) wherein the joint 22 is transverse to the longitudinal axis 18 to a second position (FIG. 5A) wherein the joint 22 is parallel to the longitudinal axis 18. At the second position, the joint 22 is secured to the base 20, for example at the attachment point 34, by the locking means 50.

Figure 5D:
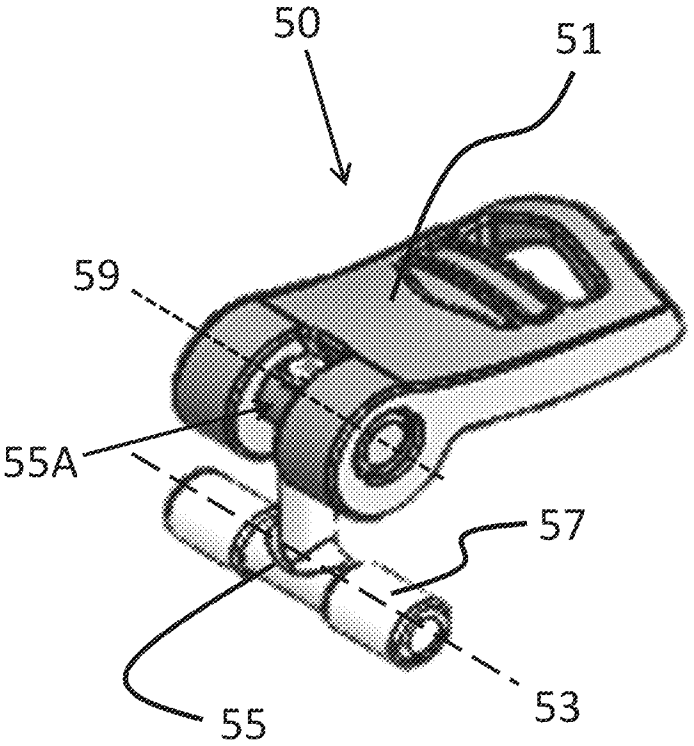
FIG. 5D illustrates a perspective view of a locking means of the coupling assembly in accordance with an example embodiment.
Figure 5C:
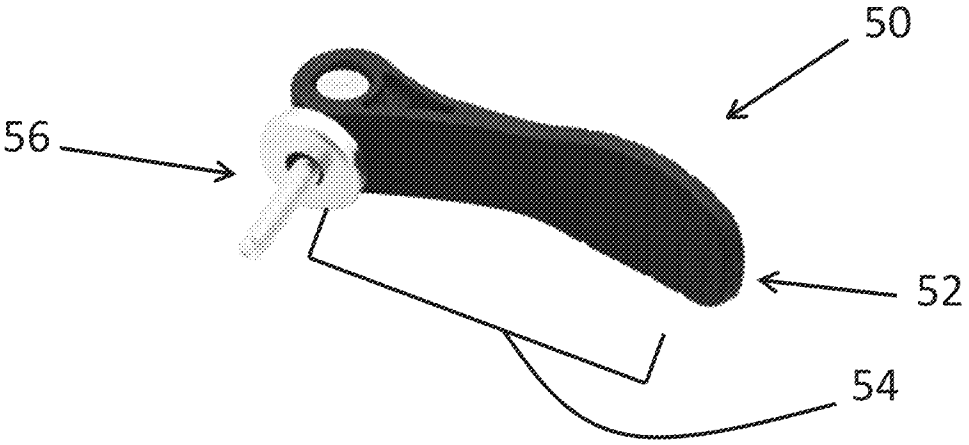
FIG. 5C illustrates a perspective view of a locking means of the coupling assembly in accordance with an example embodiment.

FIGS. 5C and 5D illustrate example embodiments of a locking means 50.

FIG. 5D illustrates a preferred example embodiment of a locking means 50 comprising a mounting member 55 on one end and a tightening control member 51 on the other end. The mounting member 55 is mounted on the base 20 and defines a mounting axis 53 perpendicular to the longitudinal axis 18. Alternatively, the mounting axis 53 may be parallel to the longitudinal axis 18. The tightening control member 51 is pivotable about a pivot axis 59 that is perpendicular to the longitudinal axis 18. The pivot axis 59 is also parallel to the mounting axis 53. The tightening control member 51 is preferably a cam lever and the mounting member 55 is a T-piece. Most preferably, the locking means 50 is a T-piece cam lever.

The cam on the tightening control member 51 advantageously has a high point to ensure pressure on the coupling assembly 16 system. By way of example, passing the high point on the cam of the tightening control member 51 fully engages the locking means 50 and ensures that the locking means 50 is securably engaged and cannot be disengaged by vibration, etc.

In an example embodiment, the mounting member 55 may be made of a strong and durable material with increased resistance to corrosion such as stainless steel. In a preferred embodiment, the mounting member 55 may include a cover 57 that acts as a separating or protective member which eliminates or at least minimises galvanic corrosion between the mounting member 55 and the base 20.

In an example embodiment, the tightening control member 51 may be made of any suitable material that provides some flexibility in the coupling assembly 16 system whilst being strong and light-weight. In a preferred embodiment, the tightening control member is made of a polyamide, most preferably PA66 plastic. This material advantageously provides high strength and low impact resistance.

Preferably, the tightening control member 51 is attached to a spindle 55A with fine threads to ensure precise calibration of the locking means 50. In an example embodiment, the spindle 55A may be integrally formed with the mounting member 55. Alternatively, the spindle 55A may be arranged to be attached with the mounting member 55. In a preferred embodiment, the spindle 55A is made of stainless steel, most preferably stainless steel 316. Advantageously, the tightening control member 51 ensures that the coupling assembly 16 can be assembled easily and efficiently even when wear occurs, making the coupling assembly 16 well suited to frequent and long-term use.

Figure 6B:
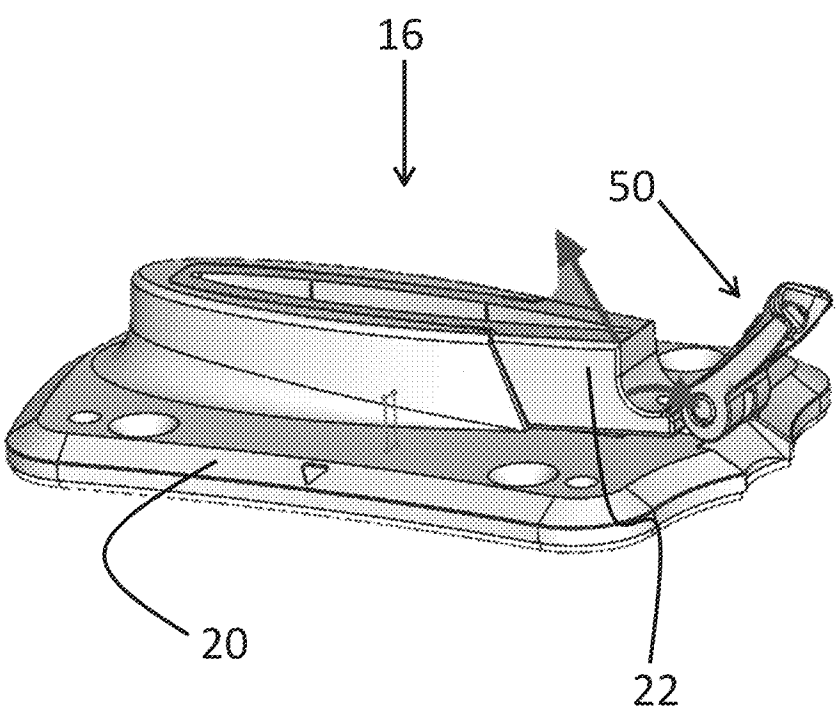
FIG. 6B is a perspective side view of a coupling assembly in a second position with the locking means in FIG. 5D in a released position in accordance with an example embodiment.
Figure 6A:
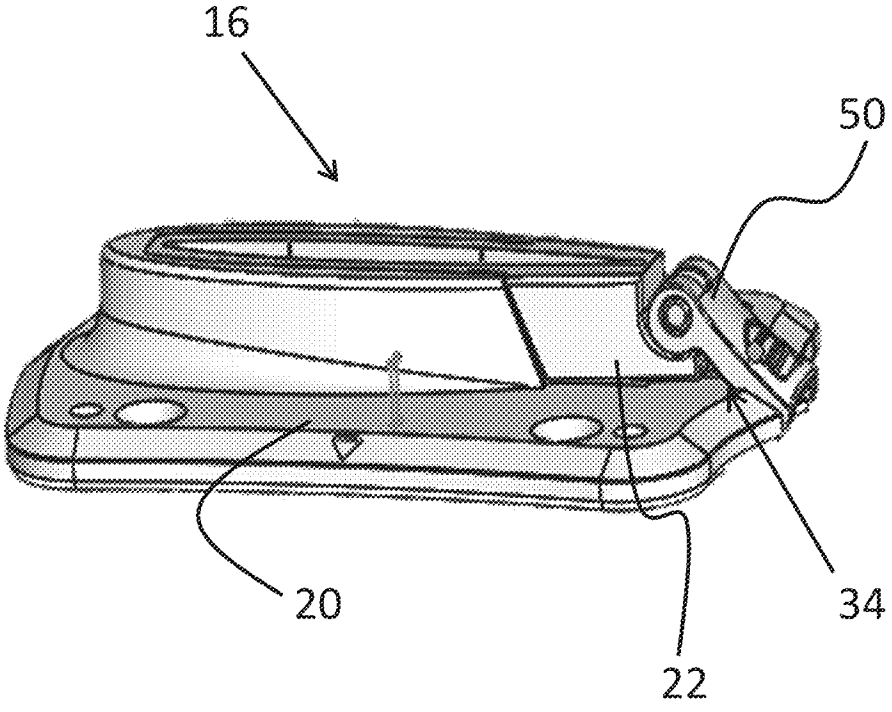
FIG. 6A is a perspective side view of a coupling assembly locked in a second position by the locking means in FIG. 5D in accordance with an example embodiment.

FIGS. 6A and 6B illustrates the coupling assembly 16 showing the joint 22 secured to the base 20 in a second position at which the joint 22 abuts and is secured to the base 20 by the locking means 50 as described above. FIG. 6A shows the locking means 50 in a locked position whereby the locking means 50 secures the joint 22 to the base 20 at, for example, an attachment point 34. FIG. 6B shows the locking means 50 in a released position whereby the tightening control means 51 pivots about the pivot axis 59 away from the base 20 and the locking means 50 is released or disengaged and moves away from the joint 22. This allows the joint 22 to be released from the base 20 and move from the first position to the second position (as shown in FIG. 3) for disassembly. The tightening control member 51 of the locking means 50 can simply be pivoted about the pivot axis 59 to assemble or disassemble the coupling assembly 16 and the locking means 50 does not need to be unscrewed, saving considerable time by negating the need for additional tools and relieving considerable effort for a user.

In an example embodiment, the locking means 50 further comprises a blocking member 60 that blocks the tightening control member 51 pivoting about the pivot axis 53. The blocking member 60 is illustrated in FIGS. 7A-7C.

Figure 7B:
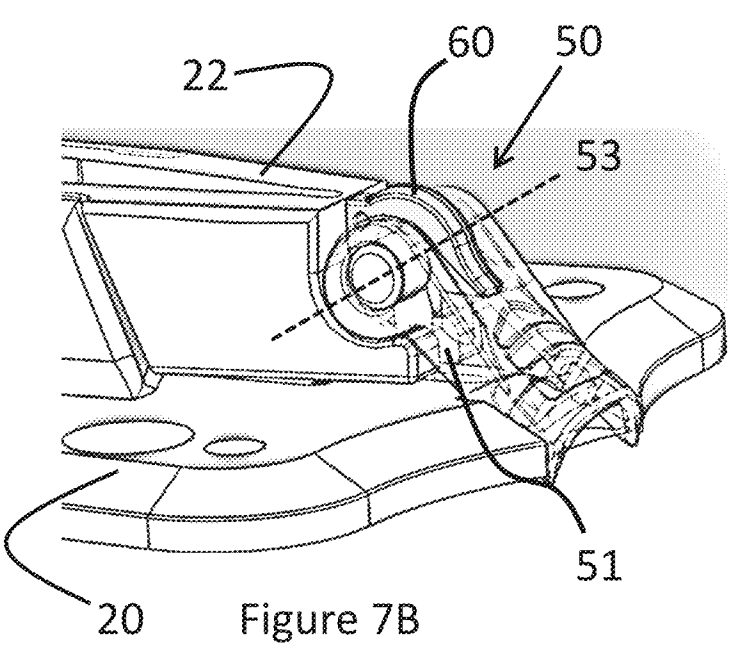
FIG. 7B is a perspective side view of a coupling assembly in a second position with the locking means engaged with the blocking member in a blocked configuration in accordance with an example embodiment.
Figure 7A:
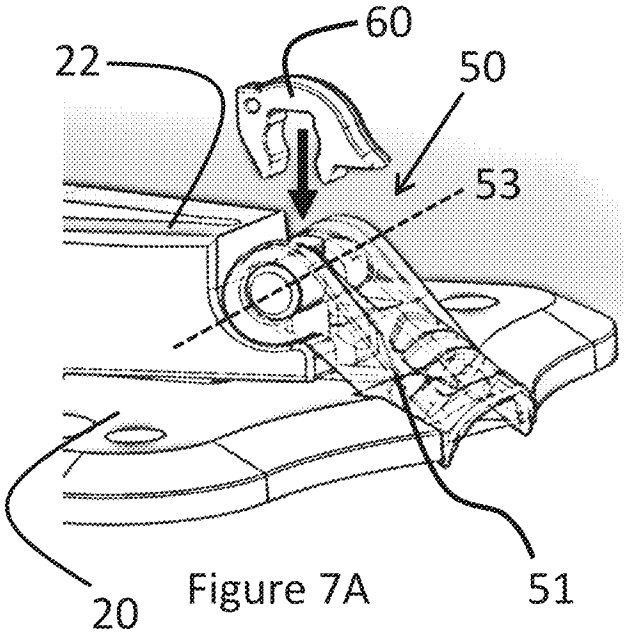
FIG. 7A is a perspective side view of a coupling assembly in a second position with the locking means in an unblocked configuration in accordance with an example embodiment.

FIG. 7A shows the locking means 50 in an unblocked configuration in which the blocking member 60 is not engaged with the tightening control member 51 and the tightening control member 51 can pivot about the pivot axis 53.

Figure 7C:
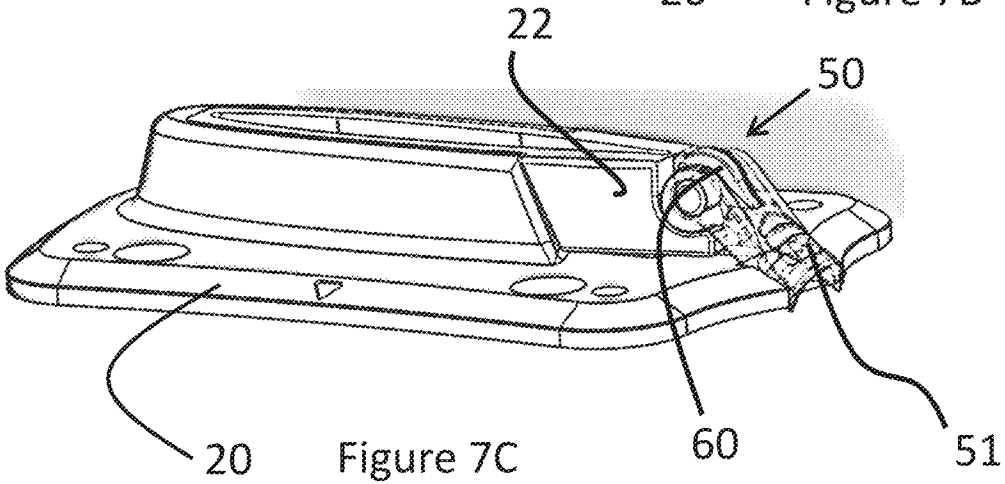
FIG. 7C is a perspective side view of a coupling assembly in a second position with the locking means engaged with the blocking member in a blocked configuration in accordance with an example embodiment.

FIG. 7B and FIG. 7C show the locking means 50 in a blocked configuration in which the blocking member 60 is engaged with the tightening control member 51 and the blocking member 60 blocks the tightening control member 51 from pivoting about the pivot axis 53.

By way of example, during assembly of the floatable apparatus 10 and/or coupling assembly 16, the joint 22 is secured to the base 20 at, for example, an attachment point 34 by the locking means 50 in a locked position (as illustrated in FIG. 6A). When the locking means 50 is in a locked position, the blocking member 60 is engaged with the locking means 50 and/or specifically the tightening control member 51 to block the tightening control member 51 pivoting about the pivot axis 53. The blocking member 60, for example, acts as a locking clamp, and prevents the locking means 50 from being released or loosened from a locked position (as shown in FIG. 6A) to a released position (as shown in FIG. 6B) during use of the floatable apparatus 10 and/or coupling assembly 16 and acts as an additional locking mechanism.

The blocking member 60 ensures that the tightening control member 51 cannot move from the locked position to the released position and the joint 22 remains secured to the base 20 even during instances of high vibration, i.e. during use of the floatable apparatus 10 in rough seas or unpredictable environments, or if the tightening control member 51 is, for example, not sufficiently tightened. This additional safety feature advantageously and reliably secures the joint 22 to the base 20 during use and prevents detachment of the coupling assembly 16.

FIG. 5C illustrates an alternative example embodiment of a locking means 50 comprising a tightening shaft 54 that includes a screw portion 56 on one end and a tightening control member 52 on the other end.

in this example embodiment, the screw portion 56 of the locking means 50 screws the joint 22 to the base 20 at the attachment point 34, for example, and the tightening shaft 54 of the locking means 50 is rotatable about the longitudinal axis 18 for rotation of the screw portion 56 to tighten the joint 22 to the base 20. After rotation of the screw portion 56, the tightening control member 52, which acts as a lever, is pivotable about an axis perpendicular to the tightening shaft 54 in order to secure the joint 22 to the base 20. Similarly, for release of the joint 22 from the base 20, the tightening control member 52 is pivoted about an axis perpendicular to the tightening shaft 54 to release the tightening shaft 54 for rotation about the axis perpendicular to the tightening shaft 54 and to unscrew the locking means 50 at the screw portion 56 such that the joint 22 may be unattached from the base 20. In a preferred embodiment, the tightening shaft 54 is shaped like the trailing edge of the profile the joint 22 to improve the hydrodynamic profile of the floatable apparatus 10.

In an example embodiment, the floatable body 12 may be a water sports board including, but not limiting to, a surfboard, stand-up paddle board, skim board, wake skate, wake surfers, or combinations thereof. Preferably, the floatable body 12 is a surfboard.

The supporting member 14 can include a wide range of accessories that may be mounted on the floatable body 12, for example, electric propulsion systems, hydrofoils, fins, fin boxes, etc. In an example embodiment, the supporting member 14 is a mast. In a preferred embodiment, the supporting member 14 is a hydrofoil mast. In a most preferred embodiment, the floatable body 12 is a surfboard and the supporting member 14 is a hydrofoil mast.

Example embodiments of the present invention also pertain to a coupling assembly for a floatable apparatus. Particularly, a coupling assembly 16 for a floatable apparatus 10 as described previously, with a floatable body 12 under which a supporting member 14 is positioned for exerting a lifting force onto the floatable apparatus 10. The coupling assembly 16, includes a base 20 adapted to secure to said floatable body 12; and a joint 22 adapted to secure to said supporting member 14 and detachably attached to the base 20, the joint 22 being movable between a first position at which the joint 22 is pivotable about and detachable from the base 20 and a second position at which the joint 22 abuts and is secured to the base 20.

The example embodiments described provide a floatable apparatus 10 that includes a floatable body 12, a supporting member 14 and a coupling assembly 16 for coupling the floatable body 12 to the supporting member 14. The floatable apparatus 10 advantageously allows for easy user handling and efficient installation and removal of the floatable apparatus via the coupling assembly without the need for additional tools whilst providing a strong and secure floatable apparatus with a sufficiently strong coupling assembly to support and couple the supporting member to the floatable body 12.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

The invention claimed is:

1. A floatable apparatus, comprising:

a floatable body defining a longitudinal axis parallel with the length of the floatable body, a supporting member positioned under the floatable body for exerting a lifting force onto the floatable apparatus, a coupling assembly coupling the floatable body to the supporting member, comprising:

a base adapted to secure to the floatable body, and a joint adapted to secure to the supporting member and detachably attached to the base, and wherein the joint is movable between a first position at which the joint is pivotable about and detachable from the base and a second position at which the joint abuts and is secured to the base, wherein the joint is secured to the base by a locking means, and the locking means comprises a mounting member on one end, a tightening control member on the other end wherein the tightening control member is pivotable about a pivot axis perpendicular to the longitudinal axis, and a blocking member that blocks the tightening control member pivoting about the pivot axis.

2. The floatable apparatus of claim 1, wherein the joint is parallel to the longitudinal axis at the second position.

3. The floatable apparatus of claim 1, wherein the joint is transverse to the longitudinal axis at the first position.

4. The floatable apparatus of claim 1, wherein the base is attached to the floatable body.

5. The floatable apparatus of claim 1, wherein the mounting member is mounted on the base and defines a mounting axis perpendicular to the longitudinal axis.

6. The floatable apparatus of claim 1, wherein the floatable body is a water sports board.

7. The floatable apparatus of claim 1, wherein the supporting member is a mast.

8. The floatable apparatus of claim 1, wherein the supporting member is a hydrofoil mast.

9. A coupling assembly for a floatable apparatus with a floatable body defining a longitudinal axis parallel with the length of the floatable body and under which a supporting member is positioned for exerting a lifting force onto the floatable apparatus, the coupling assembly comprising:

a base adapted to secure to said floatable body; and a joint adapted to secure to said supporting member and detachably attached to the base, the joint being movable between a first position at which the joint is pivotable about and detachable from the base and a second position at which the joint abuts and is secured to the base, wherein the joint is secured to the base by a locking means, and the locking means comprises a mounting member on one end, a tightening control member on the other end wherein the tightening control member is pivotable about a pivot axis perpendicular to the longitudinal axis, and a blocking member that blocks the tightening control member pivoting about the pivot axis.

10. The coupling assembly of claim 9, wherein the joint is parallel to the longitudinal axis at the second position.

11. The coupling assembly of claim 9, wherein the joint is transverse to the longitudinal axis at the first position.

12. The coupling assembly of claim 9, wherein the mounting member is mounted on the base and defines a mounting axis perpendicular to the longitudinal axis.

13. The coupling assembly of claim 9, wherein the floatable body is a water sports board.

14. The coupling assembly of claim 9, wherein the supporting member is a mast or a hydrofoil mast.

15. A floatable apparatus, comprising:

a floatable body defining a longitudinal axis parallel with the length of the floatable body, a supporting member positioned under the floatable body for exerting a lifting force onto the floatable apparatus, a coupling assembly coupling the floatable body to the supporting member, comprising:

a base adapted to secure to the floatable body, and a joint adapted to secure to the supporting member and detachably attached to the base, and wherein the joint is movable between a first position at which the joint is pivotable about and detachable from the base and a second position at which the joint abuts and is secured to the base, wherein the joint is secured to the base by a locking means, and the locking means comprises a tightening shaft including a screw portion on one end and a tightening control member on the other end wherein the tightening control member is pivotable about an axis perpendicular to the tightening shaft after rotation of the screw portion.

16. The floatable apparatus of claim 15, wherein the tightening shaft is rotatable about the longitudinal axis.

17. The floatable apparatus of claim 15, wherein the joint is parallel to the longitudinal axis at the second position.

18. The floatable apparatus of claim 15, wherein the joint is transverse to the longitudinal axis at the first position.

19. The floatable apparatus of claim 15, wherein the base is attached to the floatable body.

20. The floatable apparatus of claim 15, wherein the floatable body is a water sports board.

21. The floatable apparatus of claim 15, wherein the supporting member is a mast or a hydrofoil mast.

22. A coupling assembly for a floatable apparatus with a floatable body defining a longitudinal axis parallel with the length of the floatable body and under which a supporting member is positioned for exerting a lifting force onto the floatable apparatus, the coupling assembly comprising:

a base adapted to secure to said floatable body; and a joint adapted to secure to said supporting member and detachably attached to the base, the joint being movable between a first position at which the joint is pivotable about and detachable from the base and a second position at which the joint abuts and is secured to the base, wherein the joint is secured to the base by a locking means, and the locking means comprises a tightening shaft rotatable about the longitudinal axis, including a screw portion on one end and a tightening control member on the other end wherein the tightening control member is pivotable about an axis perpendicular to the tightening shaft after rotation of the screw portion.

23. A floatable apparatus, comprising:

a floatable body defining a longitudinal axis parallel with the length of the floatable body, a supporting member positioned under the floatable body for exerting a lifting force onto the floatable apparatus, a coupling assembly coupling the floatable body to the supporting member, comprising:

a base adapted to secure to the floatable body, and a joint adapted to secure to the supporting member and detachably attached to the base, and wherein the joint is movable between a first position at which the joint is pivotable about and detachable from the base and a second position at which the joint abuts and is secured to the base, wherein the joint is secured to the base by a locking means, and the locking means comprises a tightening shaft including a screw portion on one end and a tightening control member on the other end, wherein the tightening shaft is rotatable about the longitudinal axis.

* * * * *